United States Patent [19]

Andreoli

[11] Patent Number: 4,599,951

[45] Date of Patent: Jul. 15, 1986

[54] APPARATUS FOR DISCHARGING INCINERATION RESIDUES FROM FURNACES, PARTICULARLY REFUSE INCINERATORS

[75] Inventor: Brüno Andreoli, Uerikon, Switzerland

[73] Assignee: Von Roll AG., Gerlafingen, Switzerland

[21] Appl. No.: 772,896

[22] Filed: Sep. 5, 1985

[30] Foreign Application Priority Data

Sep. 12, 1984 [CH] Switzerland ..... 4359/84

[51] Int. Cl.[4] ..... F23J 1/02

[52] U.S. Cl. ..... 110/171; 110/165 R

[58] Field of Search ..... 110/165 R, 170, 171, 110/255, 259

[56] References Cited

U.S. PATENT DOCUMENTS 2,037,990 4/1936 Martin ..... 110/171
3,915,105 10/1975 Michelbrink ..... 110/165 R
4,020,773 5/1977 Blach ..... 110/165 R
4,048,928 9/1977 Martin ..... 110/171 X
4,281,605 8/1981 Uemura et al. ..... 110/171 X

*Primary Examiner*—Edward G. Favors
*Attorney, Agent, or Firm*—Bachman & LaPointe

[57] ABSTRACT

A water-fillable trough receives the incineration residues from the drop shaft of a furnace. A partially water-fillable discharge chute slopes upwards from the trough and is provided at its upper end with an overflow edge. A reciprocatible piston conveys the incineration residue from the trough to a circulating device arranged in the discharge chute. The circulating device is in the form of a conveyor belt or a scraper chain and conveys the incineration residues through the discharge chute to the overflow edge. A shutting-off device for separating the chute from the trough is arranged above the transition point between the trough and the chute. The shutting-off device can be in the form of a slide provided with a hoist drive which passes through the upper wall of the chute, or a flap freely suspended by means of joints on the upper chute wall, or as a rubber apron freely suspended from the upper chute wall.

5 Claims, 3 Drawing Figures

APPARATUS FOR DISCHARGING INCINERATION RESIDUES FROM FURNACES, PARTICULARLY REFUSE INCINERATORS

BACKGROUND OF THE INVENTION

The invention relates to an apparatus for discharging incineration residues from furnaces, particularly refuse incinerators, having a water-fillable trough to which the incineration residues are supplied by means of a drop shaft comprising a discharged chute having an upper wall wherein the chute adjoins the trough at a transition point wherein the chute slopes upwards from the trough and has at its upper end an overflow edge, a reciprocatible piston for moving the incineration residues from the trough to a circulating device positioned in the discharge chute, said circulating device being in the form of a conveyor means for moving the incineration residues through the discharge chute to the overflow edge wherein means for separating the chute from the trough is provided above the transition point between the trough and the chute.

Apparatuses of this general type are disclosed in Swiss Pat. Nos. 360,152 and 867,121, and suffer from the disadvantage that they cannot be operated for incinerating wood waste, bark and similar sorted, crushed refuse. Thus, such refuse produces small amounts of very light and difficultly wettable ash, which only slowly settles in water. It is also not possible to lower the water level, because the exclusion of air between the discharge chute and the drop shaft cannot be ensured by the ash alone.

Apparatus of the aforementioned typed are, for example, known from DE-OS No. 2,739,396 and DE-OS No. 2,539,615. However, in the case of the known apparatuses, it is only possible to discharge incineration residues from the trough to the chute by means of the piston when the drop shaft is sufficiently full with the residues. Thus, it is only then that, after each piston stroke, sufficient combustion residues can pass from the drop shaft to the trough to fill the piston stroke volume and form a plug, which is moved to the chute during the next stroke. In the case of the known apparatuses, the incineration residues can only be moved through the chute when it is sufficiently filled with such residues. Thus, it is only then that each plug fed to the chute is able to advance the plug of the preceding stroke enabling the incineration residues to be gradually conveyed through the chute, plug by plug, until at the end of the chute they pass into a suitable transporting means for the removal thereof. Thus, it is disadvantageous in these apparatuses that in the case of faults in the vicinity of the drop shaft or the chute, the latter cannot be operated empty, i.e. the incineration residues must be hand shovelled through the maintenance opening. This always leads to a long operating stoppage and is linked with considerable accident risks for the workers working in the trough. In addition, the need to provide for the manual emptying of the incineration residues through the maintenance opening, means that in the vicinity of the latter and the trough a considerable amount of space must be left, inter alia for the parting and movement of transportation means for removing the incineration residues which have been shovelled out.

SUMMARY OF THE INVENTION

The problem of the present invention is to eliminate the aforementioned disadvantages and to provide an apparatus of the aforementioned type which, even in the case of incomplete or inadequate filling of the drop shaft, does not have to be manually shovelled empty through the maintenance opening and which is suitable for conveying incineration residues of wood waste, bark and similar sorted crushed refuse.

According to the invention, this problem is solved by way of the present invention by providing an apparatus for discharging incineration residues from furnaces, particularly refuse incinerators, having a water-fillable trough to which the incineration residues are supplied by means of a drop shaft comprising a discharge chute having an upper wall wherein the chute adjoins the trough at a transition point wherein the chute slopes upwards from the trough and has at its upper end an overflow edge, a reciprocatible piston for moving the incineration residues from the trough to a circulating device positioned in the discharge chute, said circulating device being in the form of a conveyor means for moving the incineration residues through the discharge chute to the overflow edge wherein means for separating the chute from the trough is provided above the transition point between the trough and the chute. Advantageous further developments of the invention can be gathered from the dependent claims.

BRIEF DESCRIPTION OF THE DRAWINGS

The invention is described in greater detail hereinafter relative to non-limitative embodiments and the attached drawings, wherein show.

DETAILED DESCRIPTION

Figure 1:
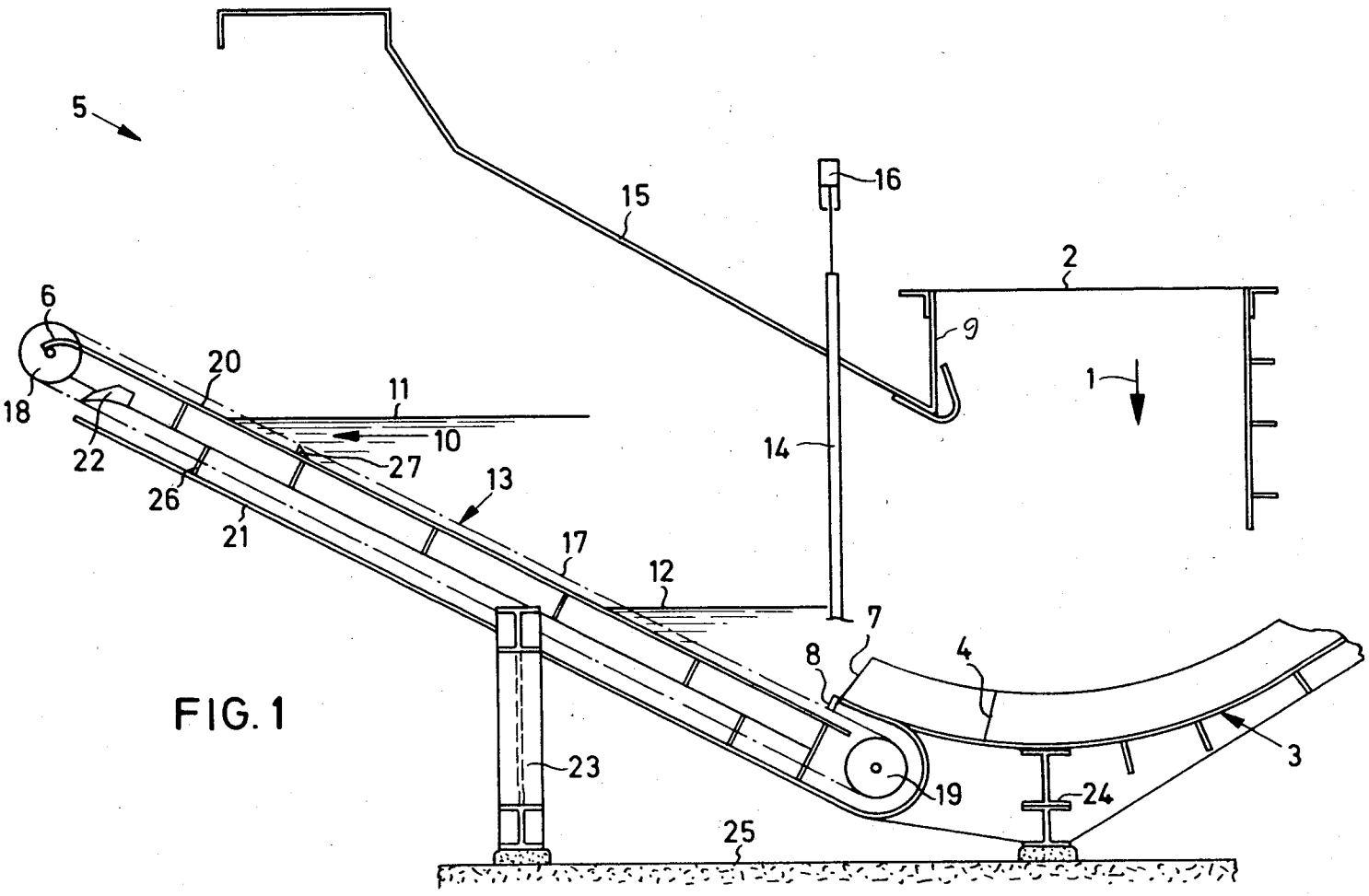
FIG. 1 is a diagrammatic side view of the apparatus according to the invention.

From a furnace not shown, incineration residues drop through a drop shaft 2 into a trough 3, in the manner indicated by arrow 1. A reciprocatible piston, of which only the front face 4 is shown, moves said incineration residues to a chute 5, which slopes upwards from trough 3 and has at its upper end an overflow edge 6. The stroke of the piston to its extended position leads its front face, designated by 7 roughly to the position designated by 8. In this position, the bottom of trough 3 passes into the bottom of chute 5 and is sealed by a sealing or shutting-off bar, i.e. this is essentially below the wall 9 of drop shaft 2. Trough 3 and chute 5 are filled with water 10, the height of the water fluctuating between an upper water level 11 and a lower water level 12.

At the bottom of chute 5 is provided a discharge mechanism 13, which essentially comprises a conveyor belt, indicated by broken lines, which is constructed as a plate, hinge or Z-belt, or as a scraper chain, particularly as a two-strand scraper chain. This discharge mechanism 13 conveys the incineration residues through chute 5 to overflow edge 6.

Figure 2:
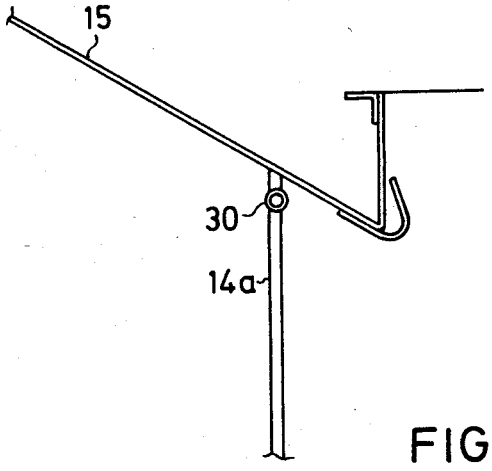
FIG. 2 is a detail from FIG. 1 in another embodiment.
Figure 3:
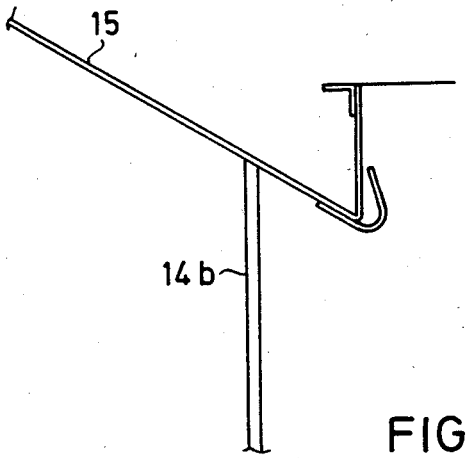
FIG. 3 is a detail corresponding to FIG. 2 in another embodiment.

Above the transition point 8, where trough 3 passes into chute 5, is provided a shutting-off device 14 which is represented as a slide with a hoist drive 16 passing through the upper wall 15 of chute 5. In a variant according to FIG. 2, the shutting-off device 14 can be constructed as a flap arranged in freely suspended manner on wall 15 by means of joints 30. In another variant according to FIG. 3, the shutting-off device 14*b* can be constructed as a rubber apron hanging down freely from wall 15. As a result of the shutting-off device 14, which is immersed in water 10, the height of the water can, if need be, be lowered to the lower water level 12, without causing an access of air from chute 5 to trough 3, which would impair the combustion conditions in the furnace. In addition, shutting-off device 14 prevents the whirling up of the suspension of the ash in water located in chute 5, as a result of the turbulence of the suspension in trough 3, so that the ash in chute 5 can settle more quickly and can then be transported away through discharge mechanism 13.

As stated hereinbefore, discharge mechanism 13 essentially comprises conveyor belt 17, which is guided over two guide pulleys 18, 19, with which are preferably associated not shown chain tension devices. Conveyor belt 17 moves around a diagrammatically indicated drawing frame 20 with a closing face and is covered at the bottom by a base plate 21.

A blower 22 is positioned close to the upper guide pulley 18 and is used for applying air or a scavenging medium to the back of conveyor belt 7, so as to remove adhering slag fragments. A further scavenging device can be associated with the lower guide pulley.

Both the discharge mechanism 13 and the trough 3 are underpinned by pillars 23, 24 projecting from a base 25.

Conveyor belt 17 can carry bars 26 as drivers while the drawing frame 20 can carry hold-back bars 27. When discharging in particular untreated domestic refuse, these prevent the sliding back of the slag plug. The bars 26 run together with the conveyor belt 17 and in the area of the above mentioned transition point 8, the sealing or shutting-off bar moves away because it has a hinge. The conveyor belt 17 consists of several chain belts and the hold-back bars 27 are arranged between these belts. when the belt 17 is loaded the top of the hold-back bars 27 rises over the surface of the belt. The holding-back bar 27 is normally constructed in such a way that the slag plug cannot slip back, while not impeding slag plug advance. This is ensured by a wedge-shaped construction.

In the upper area (in the vicinity of the drawing frame 20), discharge mechanism 13 can be equipped with at least one hold-back bar 27 and in the lower region with at least one driving bar 26. Thus, all the aforementioned operating states can be reached without any chain or conveyor belt change.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for discharging incineration residues from furnaces, particularly refuse incinerators, having a water-fillable trough to which the incineration residues are supplied by means of a drop shaft comprising a discharge chute having an upper wall wherein the chute adjoins the trough at a transition point wherein the chute slopes upwards from the trough and has at its upper end an overflow edge, a reciprocatible piston for moving the incineration residues from the trough to a circulating device positioned in the discharge chute, said circulating device being in the form of a conveyor means for moving the incineration residues through the discharge chute to the overflow edge wherein means for separating the chute from the trough is provided above the transition point between the trough and the chute.

2. An apparatus according to claim 1 wherein the means for separating comprises a movable slide which passes through the upper wall of the chute.

3. An apparatus according to claim 2 wherein the slide is provided with a hoist drive.

4. An apparatus according to claim 1 wherein the means for separating comprises a flap freely suspended from the upper wall of the chute by means of joints.

5. An apparatus according to claim 1 wherein the means for separating comprises a rubber apron hanging freely from the upper wall of the chute.

* * * * *